US010583952B2

(12) United States Patent
Fukumoto et al.

(10) Patent No.: US 10,583,952 B2
(45) Date of Patent: Mar. 10, 2020

(54) CAN BODY

(71) Applicant: TOYO SEIKAN CO., LTD., Tokyo (JP)

(72) Inventors: Hayato Fukumoto, Kanagawa (JP); Masaomi Tamura, Kanagawa (JP); Tomio Utsuno, Ibaraki (JP); Shigeyuki Matsunobu, Ibaraki (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 119 days.

(21) Appl. No.: 15/710,032

(22) Filed: Sep. 20, 2017

(65) Prior Publication Data

US 2018/0029741 A1 Feb. 1, 2018

Related U.S. Application Data

(63) Continuation-in-part of application No. PCT/JP2016/054285, filed on Feb. 15, 2016.

(30) Foreign Application Priority Data

Mar. 31, 2015 (JP) ..... 2015-073707

(51) Int. Cl.
*B65D 1/16* (2006.01)
*B65D 21/02* (2006.01)
(Continued)

(52) U.S. Cl.
CPC ..... *B65D 1/165* (2013.01); *B65D 7/44* (2013.01); *B65D 17/4012* (2018.01);
(Continued)

(58) Field of Classification Search
CPC ..... B65D 1/165; B65D 21/0219; B65D 17/4012; B65D 7/44; B65D 55/00;
(Continued)

(56) References Cited

U.S. PATENT DOCUMENTS 3,409,167 A * 11/1968 Lewis ..... B65D 79/005 220/609
3,693,828 A * 9/1972 Kneusel ..... B05B 13/0681 220/608

(Continued)

FOREIGN PATENT DOCUMENTS

CN 1061572 A 6/1992
JP 58-177325 11/1983

(Continued)

OTHER PUBLICATIONS

Official Communication issued in European Patent Office (EPO) Patent Application No. 16771922.8, dated Nov. 8, 2018.

(Continued)

*Primary Examiner* — Kareen K Thomas
(74) *Attorney, Agent, or Firm* — Greenblum & Bernstein, P.L.C.

(57) ABSTRACT

Provided is a can body containing contents such as carbonated beverages, the can body being capable of suppressing the occurrence of an unexpected opening while increasing the internal pressure resistance. In the can body, formula $(A+B)\cdot E/Z<1.88$ is satisfied when $0<L<Y2$, with the following definitions: $L=D\cdot\cos(\theta1-\theta2)$, $A=X\cdot(L+Y1-Y2)/Y1$, and $B=L+Y1-Y2$, under a condition of $E<Z$.

2 Claims, 3 Drawing Sheets

(51) Int. Cl.
*B65D 17/28* (2006.01)
*B65D 6/34* (2006.01)
*B65D 55/00* (2006.01)

(52) U.S. Cl.
CPC ..... *B65D 21/0219* (2013.01); *B65D 55/00* (2013.01); *B65D 2251/06* (2013.01); *B65D 2517/0014* (2013.01); *B65D 2517/0062* (2013.01); *B65D 2517/5091* (2013.01)

(58) Field of Classification Search
CPC .... B65D 2517/0014; B65D 2517/5091; B65D 2517/0062; B65D 2251/06
See application file for complete search history.

(56) References Cited

U.S. PATENT DOCUMENTS 3,905,507 A * 9/1975 Lyu ..... B65D 1/165 220/608
3,942,673 A * 3/1976 Lyu ..... B65D 1/165 220/608
4,120,419 A * 10/1978 Saunders ..... B65D 1/165 220/609
4,125,632 A * 11/1978 Vosti ..... B65D 15/18 206/524.8
4,147,271 A * 4/1979 Yamaguchi ..... B65D 1/165 220/606
4,151,927 A * 5/1979 Cvacho ..... B65D 1/165 220/606
4,177,746 A * 12/1979 Lee, Jr. ..... B21D 22/30 220/609
4,276,987 A * 7/1981 Michel ..... B65D 1/0276 215/10
4,412,627 A * 11/1983 Houghton ..... B65D 1/165 220/609
4,431,112 A * 2/1984 Yamaguchi ..... B65D 1/165 220/606
4,667,454 A * 5/1987 McHenry ..... B65B 55/02 426/401
5,105,973 A 4/1992 Jentzsch et al.
5,234,126 A * 8/1993 Jonas ..... B65D 1/165 215/373
5,325,696 A 7/1994 Jentzsch et al.
5,524,468 A 6/1996 Jentzsch et al.
9,260,217 B2 * 2/2016 Niec ..... B65D 17/4011

FOREIGN PATENT DOCUMENTS

JP 61-29625 9/1986
JP 1-130916 9/1989
JP 2-152667 6/1990
JP 2002-59928 2/2002
JP 2012-236624 12/2012
JP 2014-54999 3/2014

OTHER PUBLICATIONS

International Search Report issued in Patent Application No. PCT/JP2016/054285, dated May 17, 2016.
International Preliminary Report on Patentability issued in PCT/JP2016/054285, dated May 17, 2016, along with an english translation thereof.
Chinese office action issued with respect to Chinese Application No. No. 201680019146.8, dated Aug. 24, 2018.

* cited by examiner

CAN BODY

This is a Continuation-In-Part of PCT International Application No. PCT/JP2016/054285, filed Feb. 15, 2016, the contents of which is expressly incorporated by reference herein in its entirety.

TECHNICAL FIELD

The present invention relates to a can body.

BACKGROUND ART

Attempts have been made to reduce the thickness of cans in order to save natural resources and reduce cost, and various can shapes have been suggested to compensate for the decrease in can strength which accompanies such thickness reduction. In particular, the shape of a can bottom is generally known in which a dome part having a center that is recessed in a dome—like shape to the inner side is provided and a leg part projecting annularly downward of a can axis is provided around the dome part in order to increase the internal pressure resistance.

Further, in a can body to be filled with contents, such as carbonated beverages, that increase the internal pressure, molding which is called bottom reforming is generally performed by recessing an inner side connection portion of the leg part and the dome part toward the outer side of the leg part in order to further increase the internal pressure resistance (for example, see Patent Documents 1 and 2 shown below).

CITATION LIST

Patent Literature

[PTL 1] Japanese Utility Model Application Laid—open No. H01-130916

[PTL 2] Japanese Patent Application Laid—open No. 2014-54999

[PTL 3] Japanese Examined Utility Model Application Publication No. S61-29625

SUMMARY OF INVENTION

Technical Problem

In a can body designed for contents such as carbonated beverages, after the contents are filled and the can lid is seamed, the internal pressure inside the can body rises and the can lid may be curved upward. Where such curving occurs, the tip of the opening tab provided at the can lid rises from the surface (shell surface) of the curved can lid. In such a case, when the can bodies filled with the contents are stacked and the can body placed at the upper stage loses the balance, there arises a problem in that the leg part at the can bottom in the can body at the upper stage enters a gap between the tab tip and the can lid surface of the can body at the stage therebelow, and the tab is raised due to the leverage action and an unexpected opening occurs. In a can body having the can bottom subjected to the aforementioned bottom reforming, the leg part easily enters the gap between the tab tip and the can lid surface due to the recess created by the bottom reforming. Therefore, the aforementioned unexpected opening is likely to occur.

To avoid such an unexpected opening, it has been suggested to provide the shell with a protrusion protruding near the tip of the tab so as to prevent the leg part of the can bottom from entering under the tab, this approach being focused only on the form of the can lid (see PTL 3). However, the problem associated with this approach is not only that the processing of the can lid is costly, but also that the operability of the tab is degraded. Further, where attention is paid only to the form of the can bottom, the recess created by bottom reforming needs to be made shallow in order to avoid the aforementioned unexpected opening, and a high inner pressure resistance required when the carbonated beverage or the like is used as the contents cannot be obtained. In view of such circumstances, the form of a can body capable of suppressing the unexpected opening while ensuring a high internal pressure resistance needs to be found by comprehensively considering the form of the can lid and the form of the can bottom.

The present invention aims to address such a problem. Thus, it is an object of the present invention to provide a can body containing contents such as carbonated beverages, the can body being capable of suppressing the occurrence of an unexpected opening while increasing the internal pressure resistance.

Solution to Problem

In order to attain the abovementioned object, a can body according to the present invention has the following configuration.

A can body including: a can lid provided with a tab for opening; and a can bottom provided with a dome part having a center recessed to an inner side, and a leg part projecting annularly toward a lower side around the dome part, wherein a recessed part facing an outer side of the leg part is provided at a connection portion of the dome part and the leg part, and formula $(A+B)\cdot E/Z<1.88$ is satisfied when $0<L<Y2$, with the following definitions:

$L=D\cdot\cos(\theta1-\theta2)$, $A=X\cdot(L+Y1-Y2)/Y1$, and $B=L+Y1-Y2$, under a condition of $E<Z$, in the formulas, D: a distance from a tip of the tab to a surface of the can lid, E: a distance from a crossing part of a vertical line drawn from the tip of the tab and the surface of the can lid to an apex part of a seaming panel of the can lid, θ1: an angle between a straight line connecting the crossing part and the apex part of the seaming panel and a vertical line, Z: a distance from a grounding part of the leg part to a lower end of a can barrel connected to the outer side of the leg part, θ2: an angle between a straight line connecting the grounding part and the lower end of the can barrel and a vertical line, Y1: a distance from a bottom part of the recessed part to a lower end of the recessed part, Y2: a distance from the bottom part to the grounding part, and X: a distance between a vertical line passing through the lower end of the recessed part and the bottom part.

A can body including: a can lid provided with a tab for opening; and a can bottom provided with a dome part having a center recessed to an inner side, and a leg part projecting annularly toward a lower side around the dome part, wherein a recessed part facing an outer side of the leg part is provided at a connection portion of the dome part and the leg part, and formula $(A+B)\cdot E/Z<1.85$ is satisfied when $L\geq Y2$, with the following definitions:

$L=D\cdot\cos(\theta1-\theta2)$, $A=X\cdot(Y1+Y2-L)/Y1$, and $B=L+Y1-Y2$, under a condition of $E<Z$, in the formulas, D: a distance from a tip of the tab to a surface of the can lid, E: a distance from a crossing part of a vertical line drawn from the tip of the tab and the surface of the can lid to an apex part of a seaming panel of the can lid, θ1: an angle between a straight line connecting the crossing part and the apex part of the seaming panel and a vertical line, Z: a distance from a grounding part of the leg part to a lower end of a can barrel connected to the outer side of the leg part, θ2: an angle between a straight line connecting the grounding part and the lower end of the can barrel and a vertical line, Y1: a distance from a bottom part of the recessed part to a lower end of the recessed part, Y2: a distance from the bottom part to the grounding part, and X: a distance between a vertical line passing through the lower end of the recessed part and the bottom part.

Advantageous Effects of Invention

With the can body of the present invention having such features, as a result of satisfying the abovementioned conditions relating to the dimensions of the can lid and the can bottom, it is possible to suppress effectively an unexpected opening occurring at the lower stage of stacked can bodies even in the bottom-reformed can having increased internal pressure resistance.

DESCRIPTION OF EMBODIMENTS

Figure 1:
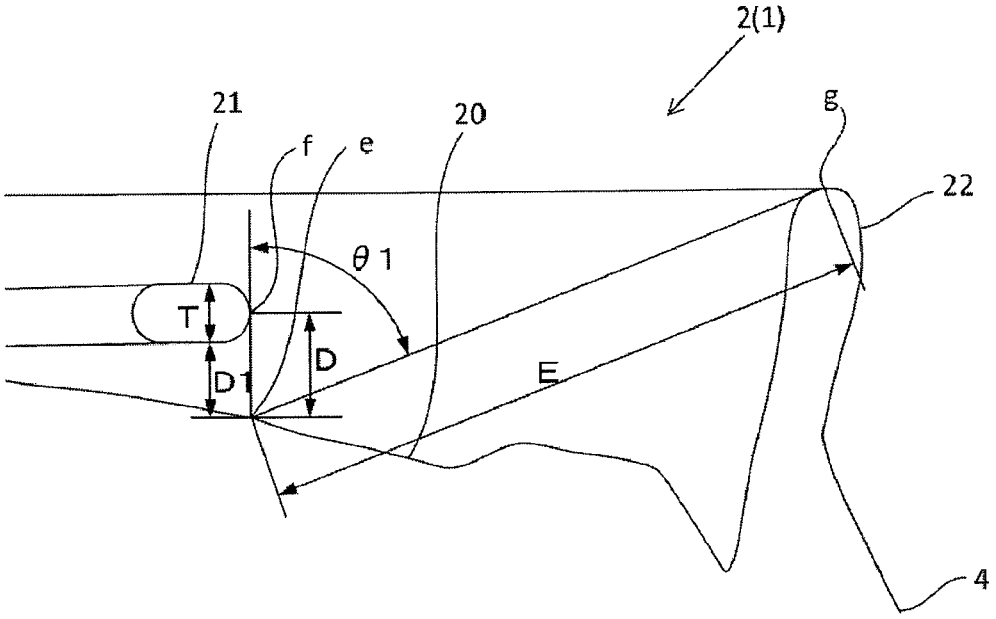
FIG. 1 is a longitudinal sectional contour diagram showing an essential part of a can lid in a can body.
Figure 2:
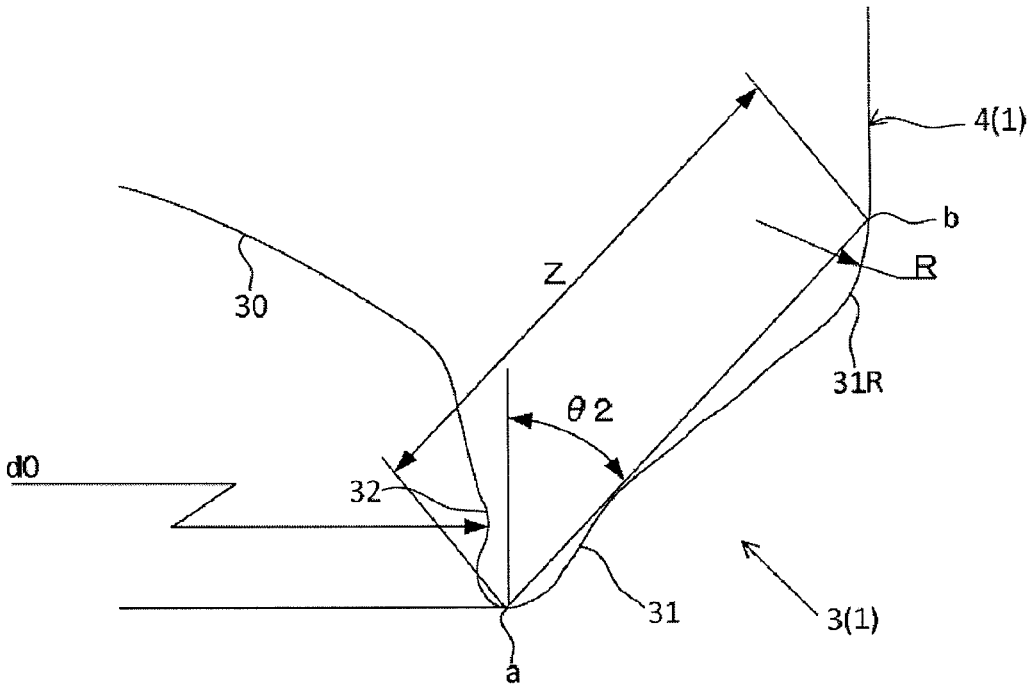
FIG. 2 is a longitudinal sectional contour diagram showing an essential part of a can bottom in a can body.
Figure 3:
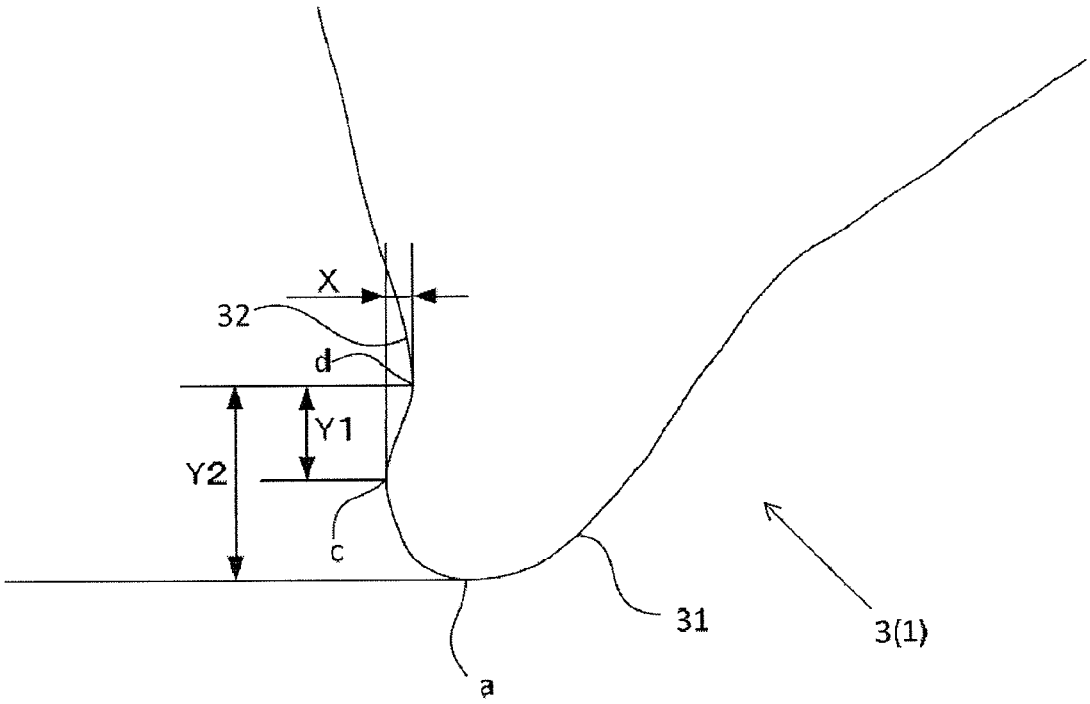
FIG. 3 is a longitudinal sectional contour diagram showing a bottom-reformed part (around a leg part) of a can bottom in a can body.

Embodiments of the present invention will be described below with reference to the drawings. FIGS. 1 to 3 show essential parts of a can body according to an embodiment of the present invention. A can body 1 includes a can lid 2, a can bottom 3, and a can barrel 4. As an example, the can body 1 is a two-piece can of an aluminum or steel material and has the can bottom 3 and the can barrel 4 integrated with each other. The stay-on-tab can lid 2 of an aluminum material is double-seamed to the flange part of the can barrel 4. The can body 1 is intended to be filled with contents and have a predetermined internal pressure.

The can lid 2 has a well-known structure in which a tab 21 for opening is attached to the central shell 20, and a seaming panel 22 is formed by being double-seamed to a flange part of the can barrel 4 around the shell 20. The can bottom 3 is provided with a dome part 30 having a center recessed to the inner side, and a leg part 31 projecting annularly toward the lower side around the dome part 30. A bottom reformed part in which a recessed part 32 is formed to face the outer side of the leg part 31 is formed at the connection portion of the dome part 30 and the leg part 31 in the can bottom 3. Further, in the example shown in FIG. 2, the outer side portion of the leg part 31 and the can barrel 4 are connected by a curved part 31R having a curvature radius R.

The can body 1 may have a curved or linear contour shape as long as the following parts can be specified. As shown in FIGS. 1 to 3, the parts to be specified are a grounding part (a) (see FIG. 2) of the leg part 31, a lower end (b) (see FIG. 2) of the can barrel 4 connected to the outer side of the leg part 31, a lower end (c) (see FIG. 3) of the recessed part 32, a bottom part (d) (see FIG. 3) of the recessed part 32, a tip (f) (see FIG. 1) of the tab, a crossing part (e) (see FIG. 1) of a vertical line drawn from the tip (f) and the surface of the can lid 2 (surface of the shell 20), and an apex part (g) (see FIG. 1) of the seaming panel 22.

The dimensions specified by appropriately selecting the above-mentioned parts (a) to (g) are determined as follows.

D: a distance from the tip (f) of the tab 21 to the surface (crossing part (e)) of the can lid 2 (D=D1+(1/2)T, D1 is a gap between the tab 21 and the surface of the can lid 2, T is the thickness of the tab).

E: a distance from the crossing part (e) of the vertical line drawn from the tip (f) of the tab 21 and the surface of the can lid 2 to the apex part (g) of the seaming panel 22 of the can lid 2.

θ1: an angle between a straight line connecting the crossing part (e) and the apex part (g) of the seaming panel 22 and a vertical line.

Z: a distance from a grounding part (a) of the leg part 31 to a lower end (b) of the can barrel 4 connected to the outer side of the leg part 31.

θ2: an angle between a straight line connecting the grounding part (a) and the lower end (b) of the can barrel 4 and a vertical line.

Y1: a distance from the bottom part (d) of the recessed part 32 to the lower end (c) of the recessed part 32.

Y2: a distance from the bottom part (d) to the grounding part (a).

X: a distance between a vertical line passing through the lower end (c) of the recessed part 32 and the bottom part (d).

Here, in the embodiment of the present invention, it is a precondition that the relationship between the distance E from the crossing part (e) of the vertical line drawn from the tip (f) of the tab 21 and the surface of the can lid 2 to the apex part (g) of the seaming panel 22 of the can lid 2, and the distance Z from the grounding part (a) of the leg part 31 to the lower end (b) of the can barrel 4 connected to the outer side of the leg part 31 be E<Z. The relationship E<Z specified herein means that when the can bodies 1 are stacked on the upper stage and the lower stage and the upper stage can body 1 loses the balance, the can barrel 4 of the can body 1 contacts the apex part (g) of the seaming panel 22, and in this state, the grounding part (a) of the leg part 31 does not enter the gap D1 between the tab 21 and the surface of the can lid 2. Where the dimensional relationship of E≥Z is valid, when the upper can body 1 loses the balance, in a state in which the can barrel 4 of the can body 1 is in contact with the apex part (g) of the seaming panel 22, the grounding part (a) of the leg part 31 may enter into the gap D1 between the tab 21 and the surface of the can lid 2, but the configuration with such a dimensional relationship is excluded from the embodiment of the present invention.

In the can body 1 according to the embodiment of the present invention, the value L determined by the following equation is defined by the aforementioned dimensions.

$$L=D\cdot\cos(\theta1-\theta2)$$

This value L is for evaluating virtually where the tip (f) of the tab 21 in the can body 1 of the lower stage contacts the inner side of the leg part 31 of the can body 1 of the upper stage when the stacked can body 1 of the upper stage loses the balance.

This value L is used to distinguish between the case in which 0<L<Y2 and the case in which L≥Y2 and to define an evaluation index α for evaluating whether an unexpected opening can easily occur by the dimensional relationship between the can lid 2 and the can bottom 3 in the following formula.

$$\alpha=(A+B)\cdot E/Z$$

However,
when 0<L<Y2, $$A=X\cdot(L+Y1-Y2)/Y1,\ B=L+Y1-Y2,\ \text{and}$$

when L Y2, $$A=X\cdot(Y1+Y2-L)/Y1,\ B=L+Y1-Y2.$$

The evaluation index α is a value that is uniquely determined only by the dimensions (E, D, θ1) of each part of the can lid 2 and the dimensions (Z, θ2, X, Y1, Y2) of each part of the can bottom 3 described hereinabove. This index makes it possible to evaluate comprehensively the relationship between the shape of the can lid 2 and the shape of the can bottom 3 and to evaluate whether an unexpected opening is likely to occur. Basically, since the value of the evaluation index α becomes larger as the value L, which is proportional to the distance D from the tip (f) of the tab 21 to the surface (crossing part (e)) of the can lid 2, increases, it can be said that an unexpected opening is more likely to occur when the evaluation index α is large. By specifying the upper limit of the evaluation index α to an appropriate value, it is possible to design the dimensions of the can body 1 (the dimensions of the can lid and the can bottom) in which an unexpected opening hardly occurs.

The evaluation index α is hereinbelow determined by actually measuring the above-mentioned dimensions with respect to the can bodies 1 for which the shape of the can lid 2 and the shape of the can bottom 3 were variously set and which were filled with contents, and the appropriate upper limit value of the evaluation index α is determined by using the test results as to whether or not an unexpected opening occurs.

<Can Lid Shape>

As the shape of the can lid 2, the dimensions of two samples ("sample A" and "sample B") were actually measured.

The dimensions D, E, θ1, and L actually measured from each sample are shown in Table 1.

TABLE 1

(UNITS: mm)

| | D | E | θ1 | L |
|---|---|---|---|---|
| SAMPLE A | 2.81 | 11.56 | 69.76 | 2.60 |
| SAMPLE B | 2.52 | 11.52 | 67.33 | 2.37 |

<Can Bottom Shape>

As the shape of the can bottom 3, the dimensions Z and θ2 of the outer side shape of the leg part 31 were made constant as shown in Table 2, and with respect to the inner side shape (bottom reformed shape) of the leg part 31, the dimensions (X, Y1, Y2) of the recessed part 32 were actually measured for the can bodies 1 obtained by setting molding rolls with different molding heights of 1.95, 2.41, 2.85, and 3.3 mm and performing molding at a reforming diameter d0 of 46.6, 46.8, 47.0, 47.2, 47.4, and 47.6 mm. The measurement results are shown in Table 3. Here, the reforming diameter d0 is a diameter corresponding to the bottom part (d) of the recessed part 32, and the molding height indicates the contact position height of the molding roll for molding the recessed part 32.

TABLE 2

(UNITS: mm)

| Z | θ2 |
|---|---|
| 12.38 | 47.42 |

TABLE 3

(UNITS: mm)

| REFORMING DIAMETER (d0) | MOLDING HEIGHT 1.95 X | 1.95 Y1 | 1.95 Y2 | 2.41 X | 2.41 Y1 | 2.41 Y2 | 2.85 X | 2.85 Y1 | 2.85 Y2 | 3.3 X | 3.3 Y1 | 3.3 Y2 |
|---|---|---|---|---|---|---|---|---|---|---|---|---|
| 46.6 | 0.14 | 0.84 | 1.81 | 0.22 | 1.29 | 2.31 | 0.27 | 1.64 | 2.71 | 0.28 | 2.03 | 3.13 |
| 46.8 | 0.20 | 0.93 | 1.82 | 0.28 | 1.30 | 2.27 | 0.37 | 1.66 | 2.69 | 0.42 | 2.09 | 3.17 |
| 47.0 | 0.22 | 0.96 | 1.80 | 0.37 | 1.37 | 2.25 | 0.42 | 1.69 | 2.67 | 0.55 | 2.10 | 3.13 |
| 47.2 | 0.23 | 0.93 | 1.74 | 0.40 | 1.37 | 2.25 | 0.54 | 1.75 | 2.70 | 0.62 | 2.09 | 3.08 |
| 47.4 | 0.32 | 1.07 | 1.79 | 0.45 | 1.41 | 2.26 | 0.60 | 1.75 | 2.67 | 0.65 | 2.11 | 3.12 |
| 47.6 | 0.37 | 1.12 | 1.82 | 0.51 | 1.38 | 2.18 | 0.66 | 1.71 | 2.58 | 0.78 | 2.04 | 2.97 |

<Calculation of Evaluation Index α>

The evaluation index α was calculated for each sample (sample A, sample B) of the can lid 2 and each molding height and reforming diameter separately for the case in which L Y2 and the case in which 0<L<Y2. The calculation results are shown in Table 4 (calculation results for sample A) and Table 5 (calculation results for sample B).

TABLE 4

<SAMPLE A>

| REFORMING DIAMETER (d0: mm) | MOLDING HEIGHT (mm) 1.95 | 2.41 | 2.85 | 3.3 |
|---|---|---|---|---|
| 46.6 | 1.53 | 1.64 | 1.66 | 1.59 |
| 46.8 | 1.63 | 1.71 | 1.79 | 1.71 |
| 47.0 | 1.68 | 1.86 | 1.89 | 1.85 |

TABLE 4-continued

| <SAMPLE A> | | | | |
|---|---|---|---|---|
| REFORMING DIAMETER | MOLDING HEIGHT (mm) | | | |
| (d0: mm) | 1.95 | 2.41 | 2.85 | 3.3 |
| 47.2 | 1.68 | 1.88 | 2.01 | 1.95 |
| 47.4 | 1.83 | 1.95 | 2.10 | 1.94 |
| 47.6 | 1.88 | 2.01 | 2.23 | 2.14 |

TABLE 5

| <SAMPLE B> | | | | |
|---|---|---|---|---|
| REFORMING DIAMETER | MOLDING HEIGHT (mm) | | | |
| (d0: mm) | 1.95 | 2.41 | 2.85 | 3.3 |
| 46.6 | 1.34 | 1.45 | 1.41 | 1.34 |
| 46.8 | 1.46 | 1.54 | 1.52 | 1.44 |
| 47.0 | 1.51 | 1.70 | 1.62 | 1.57 |
| 47.2 | 1.52 | 1.72 | 1.73 | 1.66 |
| 47.4 | 1.67 | 1.80 | 1.80 | 1.65 |
| 47.6 | 1.73 | 1.87 | 1.93 | 1.84 |

<Test to Confirm Occurrence of Unexpected Opening>

A state is realized in which the can bodies 1 to be evaluated are stacked in two stages and the can body 1 of the upper stage has lost the balance (a state in which the leg part 31 of the can body 1 of the upper stage hangs under the tab 21 of the can body 1 of the lower stage), the can body 1 of the lower stage is gradually inclined, and the inclination angle of the can body 1 of the lower stage at the time the can body 1 of the upper stage falls is measured. Here, a large value of the measured inclination angle of the can body 1 of the lower stage means that the leg part 31 is deeply hooked on the gap under the tab 21, and therefore it can be said that the occurrence of an unexpected opening is highly probable. More specifically, a case in which the upper can body does not fall even when the inclination angle of the can body 1 of the lower stage is 30° or more, is evaluated as a possibility of occurrence of an unexpected opening (failure), and such a case is indicated by underlining in the table.

<Relationship between Calculated Value of Evaluation Index a and Test Results>

Among the values of the evaluation index α shown in Table 4, when the molding height was 1.95 mm, the relationship L≥Y2 was valid over the entire range of the reforming diameter d0=46.6 mm to 47.6 mm and the evaluation index α was 1.53 to 1.88, but the value evaluated as indicating the possibility of occurrence of an unexpected opening was only 1.88.

Among the values of the evaluation index α shown in Table 4, when the molding height was 2.41 mm, the relationship L≥Y2 was valid over the entire range of the reforming diameter d0=46.6 mm to 47.6 mm and the evaluation index α was 1.64 to 2.01, but the values evaluated as indicating the possibility of occurrence of an unexpected opening were 1.86 to 2.01.

Among the values of the evaluation index α shown in Table 4, when the molding height was 2.85 mm, the relationship 0<L<Y2 was valid over the entire range of the reforming diameter d0=46.6 mm to 47.4 mm, and the relationship L≥Y2 (L=2.60, Y2=2.58) was valid at the reforming diameter d0=47.6 mm, and the evaluation index α was 1.66 to 2.23, but the values evaluated as indicating the possibility of occurrence of an unexpected opening were 1.89 to 2.23.

Among the values of the evaluation index α shown in Table 4, when the molding height of 3.3 mm, the relationship 0<L<Y2 was valid over the entire range of the reforming diameter d0=46.6 mm to 47.6 mm and the evaluation index α was 1.59 to 2.14, but the values evaluated as indicating the possibility of occurrence of an unexpected opening were 1.95 to 2.14.

Among the values of the evaluation index α shown in Table 5, when the molding height was 1.95 mm, the relationship L≥Y2 was valid over the entire range of the reforming diameter d0=46.6 mm to 47.6 mm and the evaluation index α was 1.34 to 1.73, but there were no values evaluated as indicating the possibility of occurrence of an unexpected opening.

Among the values of the evaluation index α shown in Table 5, when the molding height was 2.41 mm, the relationship L≥Y2 was valid over the entire range of the reforming diameter d0=46.6 mm to 47.6 mm and the evaluation index α was 1.45 to 1.87, but the value evaluated as indicating the possibility of occurrence of an unexpected opening was only 1.87.

Among the values of the evaluation index α shown in Table 5, when the molding height was 2.85 mm, the relationship 0<L<Y2 was valid over the entire range of the reforming diameter d0=46.6 mm to 47.6 mm and the evaluation index α was 1.41 to 1.93, but the value evaluated as indicating the possibility of occurrence of an unexpected opening was only 1.93.

Among the values of the evaluation index α shown in Table 5, when the molding height was 3.3 mm, the relationship 0<L<Y2 was valid over the entire range of the reforming diameter d0=46.6 mm to 47.6 mm and the evaluation index α was 1.34 to 1.84, but there were no values evaluated as indicating the possibility of occurrence of an unexpected opening.

The relationship between the evaluation index α and the test results described above indicates that by setting the upper limit value of the evaluation index α, it is possible to set comprehensively the can lid dimensions and the can bottom dimensions at which the occurrence of an unexpected opening can be avoided. Further, it can be seen from the test results that when L≥Y2, the occurrence of an unexpected opening can be avoided at α<1.85 (or α<1.86), and when L>Y2, the occurrence of an unexpected opening can be avoided at α<1.88 (α<1.89).

Thus, according to the present invention, the possibility of occurrence of an unexpected opening can be accurately evaluated by using the evaluation index α which comprehensively takes into account the dimensions of the can lid 2 and the dimensions of the can bottom 3 of the can body 1. Therefore, it is possible to design freely the shape of the can body 1 or the barrel diameter (capacity) within an appropriate range of the evaluation index α, and it is possible to obtain can bodies with a variety of shape variations which have a high internal pressure resistance and no occurrence of an unexpected opening.

REFERENCE SIGNS LIST

1 Can body
2 Can lid
3 Can bottom
4 Can barrel
20 Shell
21 Tab
22 Seaming panel
30 Dome part

31 Leg part
31R Curved part
32 Recessed part

The invention claimed is:

1. A can body comprising: a can lid provided with a tab for opening; and a can bottom provided with a dome part having a center recessed to an inner side, and a leg part projecting annularly toward a lower side around said dome part, wherein a recessed part facing an outer side of said leg part is provided at a connection portion of said dome part and said leg part, the can body satisfying: a first resulting quantity (A), a second resulting quantity (B) and a third resulting quantity (L), wherein a distance from a tip of said tab to a surface of said can lid (D), a distance from a crossing part of a vertical line drawn from the tip of said tab and the surface of said can lid to an apex part of a seaming panel of said can lid (E), an angle between a straight line connecting said crossing part and said apex part of the seaming panel and a vertical line (θ1), a distance from a grounding part of said leg part to a lower end of a can barrel connected to the outer side of said leg part (Z), an angle between a straight line connecting said grounding part and the lower end of said can barrel and a vertical line (θ2), a distance from a bottom part of said recessed part to a lower end of said recessed part (Y1), a distance from said bottom part to said grounding part (Y2), and a distance between a vertical line passing through the lower end of said recessed part and said bottom part (X) are provided, and wherein:

$$(A+B)\cdot E/Z<1.88$$

is satisfied when $$0<L<Y2,$$

with the following definitions:

$$L=D\cdot\cos(\theta1-\theta2),$$

$$A=X\cdot(L+Y1-Y2)/Y1, \text{ and}$$

$$B=L+Y1-Y2,$$

under a condition of E<Z.

2. A can body comprising: a can lid provided with a tab for opening; and a can bottom provided with a dome part having a center recessed to an inner side, and a leg part projecting annularly toward a lower side around said dome part, wherein a recessed part facing an outer side of said leg part is provided at a connection portion of said dome part and said leg part, the can body satisfying: a first resulting quantity (A), a second resulting quantity (B) and a third resulting quantity (L), wherein a distance from a tip of said tab to a surface of said can lid (D), a distance from a crossing part of a vertical line drawn from the tip of said tab and the surface of said can lid to an apex part of a seaming panel of said can lid (E), an angle between a straight line connecting said crossing part and said apex part of the seaming panel and a vertical line (θ1), a distance from a grounding part of said leg part to a lower end of a can barrel connected to the outer side of said leg part (Z), an angle between a straight line connecting said grounding part and the lower end of said can barrel and a vertical line (θ2), a distance from a bottom part of said recessed part to a lower end of said recessed part (Y1), a distance from said bottom part to said grounding part (Y2), and a distance between a vertical line passing through the lower end of said recessed part and said bottom part (X) are provided, and wherein:

$$(A+B)\cdot E/Z<1.85$$

is satisfied when $$L\geq Y2,$$

with the following definitions:

$$L=D\cos(\theta1-\theta2),$$

$$A=X\cdot(Y1+Y2-L)/Y1, \text{ and}$$

$$B=L+Y1-Y2,$$

under a condition of E<Z.

* * * * *